US007879131B2

(12) United States Patent
Yaniv et al.

(10) Patent No.: US 7,879,131 B2
(45) Date of Patent: Feb. 1, 2011

(54) METAL ENCAPSULATION

(75) Inventors: Zvi Yaniv, Austin, TX (US); Prabhu Soundarrajan, Valencia, CA (US)

(73) Assignee: Applied Nanotech Holdings, Inc., Austin, TX (US)

( * ) Notice: Subject to any disclaimer, the term of this patent is extended or adjusted under 35 U.S.C. 154(b) by 304 days.

(21) Appl. No.: 11/839,257

(22) Filed: Aug. 15, 2007

(65) Prior Publication Data

US 2008/0210742 A1 Sep. 4, 2008

Related U.S. Application Data

(60) Provisional application No. 60/837,708, filed on Aug. 15, 2006.

(51) Int. Cl.
*B22F 9/06* (2006.01)
*B22F 9/24* (2006.01)

(52) U.S. Cl. ..... 75/351; 75/332; 75/371; 977/777; 977/888; 977/896

(58) Field of Classification Search ..... None
See application file for complete search history.

(56) References Cited

U.S. PATENT DOCUMENTS

| | | | | |
|---|---|---|---|---|
| 6,042,702 | A | 3/2000 | Kolouch et al. | |
| 6,165,247 | A * | 12/2000 | Kodas et al. | 75/331 |
| 6,975,063 | B2 | 12/2005 | Mao et al. | |
| 6,992,434 | B2 | 1/2006 | Terada et al. | |
| 7,053,034 | B2 | 5/2006 | Shefer et al. | |
| 7,083,859 | B2 * | 8/2006 | Kuwajima | 428/570 |
| 2002/0096986 | A1 | 7/2002 | Motoi et al. | |
| 2004/0055420 | A1 * | 3/2004 | Garbar et al. | 75/370 |

(Continued)

FOREIGN PATENT DOCUMENTS

| | | |
|---|---|---|
| EP | 1245704 | 2/2002 |

(Continued)

OTHER PUBLICATIONS

Blanchet, et al., "Large area, high resolution, dry printing of conducting polymers for organic electronics", *Applied Physics Letters*, Jan. 20, 2003, 82(3): pp. 463-465, American Institute of Physics, US.

(Continued)

*Primary Examiner*—George Wyszomierski
(74) *Attorney, Agent, or Firm*—Kelly Kordzik; Matheson Keys Garsson & Kordzik

(57) ABSTRACT

A process for encapsulating metal microparticles in a pH sensitive polymer matrix using a suspension containing the polymer. The process first disperses the metal particles in a polymeric solution consisting of a pH sensitive polymer. The particles are then encapsulated in the form of micro-spheres of about 5-10 microns in diameter comprising the pH sensitive polymer and the metal ions ($Ni^{2+}$, $Cu^{2+}$) to be coated. The encapsulated matrix includes first metal particles homogeneously dispersed in a pH sensitive matrix, comprising the second metal ions. A high shear homogenization process ensures homogenization of the aqueous mixture resulting in uniform particle encapsulation. The encapsulated powder may be formed using spray drying. The powder may be then coated in a controlled aqueous media using an electroless deposition process. The polymer is removed when the encapsulated micro-spheres encounter a pH change in the aqueous solution.

19 Claims, 7 Drawing Sheets

U.S. PATENT DOCUMENTS

2004/0063839 A1 4/2004 Kawate et al.
2004/0234597 A1 11/2004 Shefer et al.

FOREIGN PATENT DOCUMENTS

JP 09035620 2/1997

OTHER PUBLICATIONS

Bose, et al., "Microencapsulated Powder Approach for Advanced Materials", Jul. 31, 2006, File://C:\unzipped\Referenced%20Literature\ Referenced%20Literature\Reference%201.htm, pp. 2-9.
Bose, et al., "Potential of Coated Powders for Powder Injection Molding", Jul. 31, 2006, File://C:\unzipped\Referenced%20Literature\Referenced%20Literature\Reference%201.htm, pp. 14-21.
Burns et al., "3.4: Flexible Active-Matrix Displays", *SID 05 Digest*, pp. 19-21, 2005 SID, US.
Calvert, et al., "Inkjet Printing for Materials and Devices", *Chem. Mater*., Sep. 12, 2001, 13(10): pp. 3299-3305, American Chemical Society.
Choi, et al., "Self-Organized Organic Thin-Film Transistors on Plastic", *Advanced Materials 2004*, Apr. 19, 2004, 16(8): pp. 732-736, 2004 WILEY-VCH Verlag GmbH & Co. KGaA, Weinheim, Germany.
Chung et al., "Is AMOLED TV ready to Enter the Battle for Large-Screen FPD Dominance?", *Information Display Feb. 2006*, Feb. 2006, pp. 12-17, SID 2006, US.
Curling, "14" Prototype Line for Manufacturing Flexible Active Matrix Displays", *USDC Flexible Displays & Microelectronics 2006*, Feb. 2006, pp. 1-19, Plastic Logic Unlimited, Cambridge CB4 OFX, UK.
Duan, et al., "High-performance thin-film transistors using semiconductor nanowires and nanoribbons", *Nature*, Sep. 18, 2003, pp. 264-278, www.nature.com, Nature Publishing Group.
Eder, et al., "Organic electronics on paper", *Applied Physics Letter*, Apr. 5, 2004, 84(14): pp. 2673-2675, American Institute of Physics, US.
Edwards, et al., "Precision Industrial Ink Jet Printing Technology for Full Color PLED Display Manufacturing", www.litrex.com, Litrex Corp., US, 2003.
Gelinck, et al., "3.1: *Invited Paper*: Rollable QVGA Active-Matrix Displays Based on Organic Electronics", *SID 05 Digest*, pp. 6-9, 2005 SID.
Ghosh et al., "OLEDs: The Challenges Ahead", *Information Display Feb. 2006*, Feb. 2006, pp. 26-31, SID 2006, US.
Huitema, et al., "Rollable Active-matrix Electronic-paper Displays", *IDW/AD '05*, pp. 857-860.
Hong, et al., "3.5: *Invited Paper*: Recent Progress in Large Sized & High Performance Organic TFT Array", *SID 05 Digest*, pp. 23-25, 2005 SID, US.
http://www.powdermetinc.com/Technology.
html#INTRODUCTION, Aug. 13, 2007.
Inoue, et al., "Surface-Free Technology by Laser Annealing (SUFTLA) and Its Application to Poly-Si TFT-LCDs on Plastic Film With Integrated Drivers", *IEEE Transactions on Electron Devices*, Aug. 2002, 49(8): pp. 1353-1360, IEEE.
Jang, et al., "3.2: *Invited Paper*: High-Performance OTFTs on Flexible Substrate", *SID 05 Digest*, pp. 10-13, 2005 SID, US.
Jin, et al., "Pentacene organic field-effect transistor on metal substrate with spin-coated smoothing layer", *Applied Physics Letters*, Nov. 8, 2004, 85(19): pp. 4406-4408, American Institute of Physics, US.
Kane, et al., "Analog and Digital Circuits Using Organic Thin-Film Transistors on Polyester Substrates", *IEEE Electronic Device Letter*, Nov. 2000, 21(11): pp. 534-536, IEEE.
Kanicki, et al., "Organic Field-Effect Transistors for Flat-Panel Displays", *Society for Information Display* , May 23, 2005, pp. 1-81, www.eecs.umich.edu/omelab, University of Michigan-Ann Arbor, US.
Kato, et al., "High mobility of pentacene field-effect transistors with polyimide gate dielectric layers", *Applied Physics Letters* , May 10, 2004, 84(19): pp. 3789-3791, American Institute of Physics, US.
Klauk, et al., "Pentacene organic transistors and ring oscillators on glass and on flexible polymeric substrates", *Applied Physics Letters*, Jun. 9, 2003, 82(23): pp. 4175-4177, American Institute of Physics, US.
Li, et al., "Direction-Dependent Homoepitaxial growth of GaN Nanowires", *Advanced Materials*, (2006), 18: pp. 216-220, www.advmat.de, 2004 WILEY-VCH Verlag GmbH & Co. KGaA, Weinheim, Germany.
Ludwig, et al., "Displays for Printed Electronics Using Soluble Organic Semiconductors", *Information Display Feb. 2006*, Feb. 2006, pp. 18-24, SID 2006, US.
Nagahara, et al., "Directed placement of suspended carbon nanotubes for nanometer-scale assembly", *Applied Physics Letter*, May 20, 2002, 80(20): pp. 3826-3828, American Institute of Physics, US.
Nishimura, et al., "Fabrication of CNT field-emitter array using a polymer insulator", *Journal of the SID*, (2005), pp. 719-725, SID.
Novak, et al., "Flexible Carbon Nanotube Thin-Film Transistors", *IDW/AD '05*, pp. 257-259.
Peng, et al., "Dielectrophoresis Field Flow Fractionation of Single-Walled Carbon Nanotubes", *JACS Communications*, Jun. 9, 2006, p. Est: 1.9, American Chemical Society.
Reuss, et al., "Macroelectronics: Perspectives on Technology and Applications", *Proceedings of the IEEE*, Jul. 7, 2005, 93(7): pp. 1239-1256, IEEE.
Rutherford, "Flexible Substrates and Packaging for Organic Displays and Electronics", *Information Display Nov. 2005*, Feb. 2005, pp. 20-25, SID 2005, US.
Sharma, et al. "Direct synthesis of single-crystalline silicon nanowires using molten gallium and silane plasma", *Nanotechnology*, (2004), 15: pp. 130-134, Institute of Physics Publishing, UK.
Sheraw, et al., "Organic thin-film transistor-driven polymer-dispersed liquid crystal displays on flexible polymeric substrates", *Applied Physics Letters*, Feb. 11, 2002, 80(6): pp. 1088-1090, American Institute of Physics, US.
Schroder, et al., "Broadcast Photonic Curing of Metallic Nanoparticle Films", 2006.
Sherman, et al., "Recirculating Fast-Fluidized Bed Pilot Plant Reactor for CVD Coated Powder Production": 6 pgs., Aug. 13, 2007.
Snow, et al., "Carbon nanotube networks: : Nanomaterial for macroelectronic applications", *Journal of Vacuum Science & Technology B*, Aug. 2004, 22(4): pp. 1990-1994.
Snow, et al., "1/*f* noise in single-walled carbon nanotube devices", *Applied Physics Letters*, Nov. 1, 1994, 85(18): pp. 4172-4174, American Institute of Physics, US.
Snow, et al., "High-mobility carbon-nanotube thin-film transistors on a polymeric substrate", *Applied Physics Letters*, (2005), 86(033105): pp. 1-3, American Institute of Physics, US.
Snow, et al., "Random networks of carbon nanotubes as an electronic material", *Applied Physics Letters*, Mar. 31, 2003, 82(13): pp. 2145-2147, American Institute of Physics, US.
Sunkara, et al., "Bulk synthesis of nanowires using a low-temperature vapor-liquid-solid method", *Applied Physics Letters*, Sep. 3, 2001, 79(10): pp. 1546-1548, American Institute of Physics, US.
Takenobu et al., "High-Performance transparent flexible transistors using carbon nanotube films", *Applied Physics Letters*, (2006), 88(033511): pp. 1-3, American Institute of Physics, US.
Yamaguchi, et al., "71.1: *Invited Paper*: A 36-inch Surface-conduction Electron-emitter Display (SED)", *SID 05 Digest*, pp. 1929-1931, 2005 SID, US.
Yamamoto, et al., "Fabrication and characterization of surface-conduction electron emitters for SED application", *Journal of the SID*, (2006), pp. 73-79, Society for Information Display.
Yamamoto, et al., "71.2: *Invited Paper*: Fabrication and Characterization of Surface Conduction Electron Emitters", *SID 05 Digest*, pp. 1933-1935, 2005 SID, US.
Young, et al., "Thin-film-transistor-and diode-addressed AMLCDs on polymer substrates", *Journal of SID*, (1997), pp. 275-281, SID.

* cited by examiner

| Material | Diameter | Mass/Al Particle | Density | Mol. Wt | Mass/100g Al |
|---|---|---|---|---|---|
| Aluminum (70 wt %) | 10-20μm | 11ng | 2.7 g/cm$^3$ | 27g | 100g |
| Nickel (30 wt %) | 2-3μm | 19ng | 8.9 g/cm$^3$ | 58g | 1.72g |
| Polymer | ~5μm | n/a | 638.9 g/L | 500KDa | 8.79g |

FIG. 4

| Material | Diameter | Mass/W particle | Density | Mol. Wt | Mass/100g Al |
|---|---|---|---|---|---|
| Tungsten (80 wt %) | 0.5-1μm | 10pg | 19.2 g/cm$^3$ | 184g | 100g |
| Copper (20 wt %) | 40nm-450nm | 4.5pg | 8.9 g/cm$^3$ | 59g | 0.45g |
| Polymer | ~1μm | n/a | 638.9 g/L | 500KDa | 0.23g |

FIG. 5

METAL ENCAPSULATION

This application for patent claims priority to U.S. Provisional Patent Application Ser. No. 60/837,708 filed on Aug. 15, 2006.

BACKGROUND INFORMATION

The ability to uniformly apply an element onto a micron or sub-micron particulate allows for the development of a new class of materials that may be used to engineer coatings and/or bulk materials with greater precision. The industry and military have requirements for the production of encapsulated particulates, having diameters in the range of 1-10 μm, which have a high-purity, uniform coating over the entire surface area of the particulate. These size particulates, which fall into Geldart's Class C category of particulate material, often have high aspect ratios and cause particular problems when attempts are made to consolidate them, since they tend to agglomerate and are difficult to handle and process. An ability to control the thickness of the coating is a requirement, as well as an ability to economically produce at high-volume production rates (thousands of pounds). These materials could then be used by the military to produce weapons with greater lethality and to solve a variety of problems that have plagued the armed forces and the commercial sector for years, such as lead-based munitions. The development of this technology will also provide for significant advances in combustion and propulsion science, resulting in the production of munitions with greater scaled lethality.

There are two major challenges in manufacturing encapsulated powders for cold spraying applications with controlled surface properties; or, if multiphase powders are produced, with controlled phase distribution to be used for manufacturing environmentally friendly ammunitions including bullets. The first challenge is that these powders are in the size regime of 1-10 μm (Geldart's Class C category of particulate material), which makes them very cohesive and difficult to handle, fluidize, and process in a non-agglomerated form. Thus, obtaining a uniform coating from this process becomes extremely difficult due to undesirable hard agglomerates. The second challenge is to produce these coatings at a reasonable cost. Currently, the cost of manufacturing these powders is prohibitive, limiting their useful applications.

PRIOR ART

1) Encapsulation Technology (U.S. Patent No. US2004/0234597A1, pH triggered site specific targeted controlled drug delivery system for the treatment of cancer; U.S. Pat. No. 7,053,034, Targeted controlled delivery compositions activated by changes in pH or salt concentration). Discloses an encapsulation technology using a pH sensitive polymer for specific targeted controlled drug delivery and timed release applications. Also discloses a method for targeted control delivery by using a release mechanism from the polymer matrix.

2) Metallization of Carbon Nanotubes for Field Emission Applications (U.S. Pat. No. 6,975,063). Discloses a metal coating process to coat metal nanoparticles onto nanostructures including carbon nanotubes, and further uses this technology for field emission applications.

SUMMARY

The present invention addresses the foregoing needs by disclosing a low-cost encapsulation technology to prevent particle agglomeration. The disclosed method includes a process for encapsulating metal microparticles in a pH sensitive polymer matrix using a suspension containing the polymer. The process first disperses the metal particles in a polymeric solution consisting of a pH sensitive polymer. The particles are then encapsulated in the form of micro-spheres of about 5-10 microns in diameter comprising the pH sensitive polymer and the metal ions ($Ni^{++}$, $Cu^{++}$) to be coated. The encapsulated matrix includes first metal particles homogeneously dispersed in a pH sensitive matrix, comprising the second metal ions. A high shear homogenization process ensures homogenization of the aqueous mixture resulting in uniform particle encapsulation. The encapsulated powder may be formed using spray drying. The powder may be then coated in a controlled aqueous media using an electroless deposition process. The polymer is removed when the encapsulated micro-spheres encounter a pH change in the aqueous solution. Electroless deposition is a chemical coating of a conductive material onto a base material surface by reduction of metal ions in a chemical solution without using electrodes and potential as compared to electroplating.

Embodiments for the present invention establish a foundation nano-sized powder processing that may help increase the lethality of weapons due to their increased surface to bulk ratio. The disclosed invention is an improvement over powder metallurgy techniques like recirculating fast-fluidized bed chemical vapor deposition processing techniques (RFFB-CVD) and powder injection molding techniques, which are currently limited to micron size particles due to their processing limitations. This invention prevents the agglomeration of the metal microparticles that fall under Geldart's Class C category and also prevents the oxidation of metal particles during the powder manufacturing process. The disclosed invention is cost effective to scale up.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, the advantages thereof, reference is now made to the following descriptions taken in conjunction with the accompanying drawings, in which:

FIG. 4 illustrates a table showing material properties in the encapsulation;

FIG. 5 illustrates a table showing W—Cu material properties for encapsulation;

DETAILED DESCRIPTION

In the following description, numerous specific details are set forth to provide a thorough understanding of the present invention. However, it will be obvious to those skilled in the art that the present invention may be practiced without such specific details.

Figure 1:
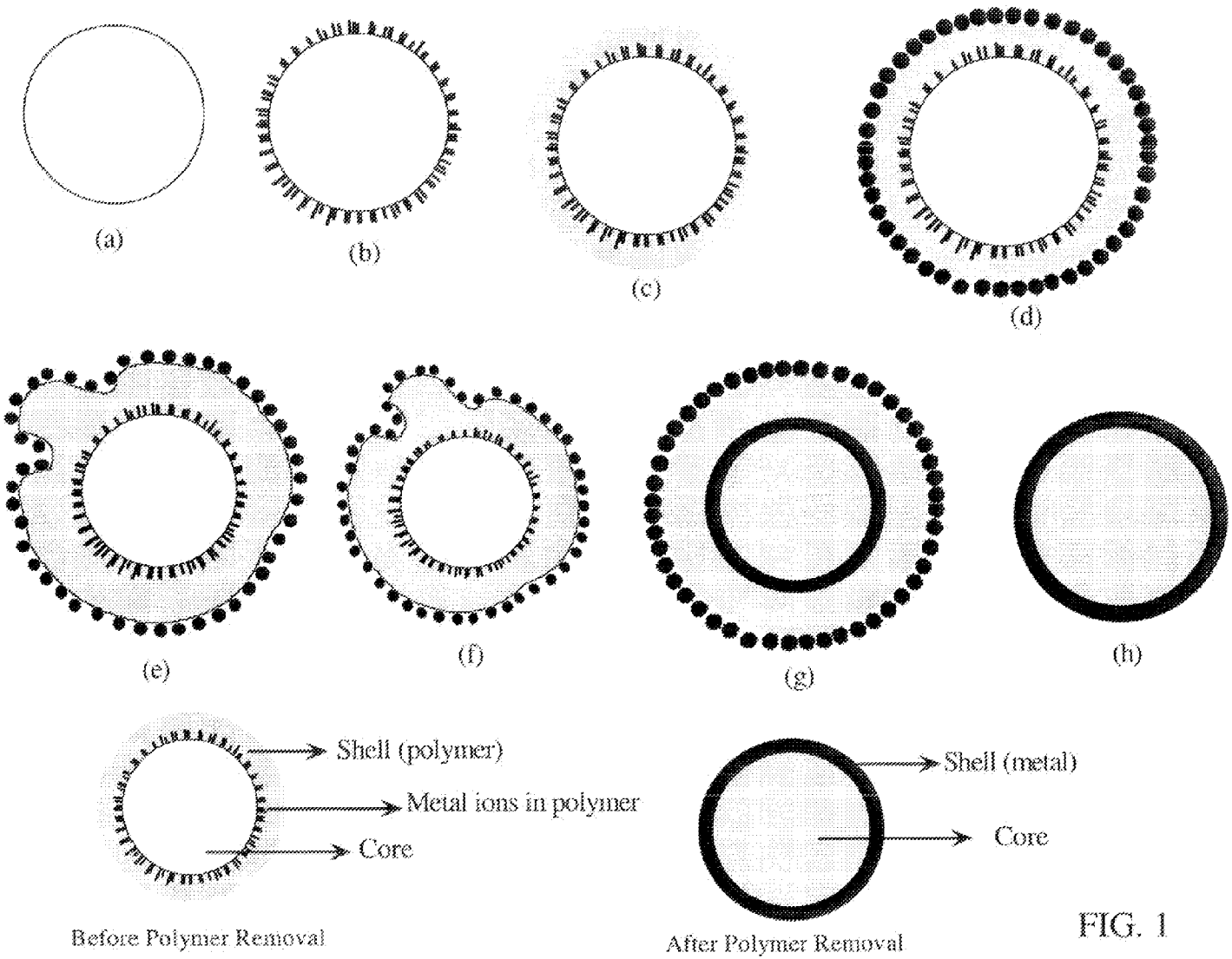
FIG. 1 illustrates metal encapsulation followed by polymer removal.

FIG. 1 shows an overview of embodiments of the present invention. A core-shell structure is disclosed for the encapsulating process. The core is the material that is encapsulated (e.g., metal micro/nano particles) and a shell is a material (polymer) that is the encapsulant. The shell may contain an additional component (e.g., metal ion) to promote the coating process. FIG. 1 also shows the core-shell structure before (FIG. 1(*a*)) and after metal coating (FIG. 1(*d*)). FIG. 1(*a*) shows a metal micro or nanoparticle, e.g., 10-20 μm sized Al/0.5-1 μm W. FIG. 1(*b*) illustrates the Al/W particle pretreated with acid to form a rough surface in order to create nucleation centers. This is an optional step in the process. FIG. 1(*c*) illustrates the Al/W particle coated with a layer of polymer. FIG. 1(*d*) illustrates the polymer-Al/W particle coated with Ni or Cu, for example using an electroless plating bath. FIG. 1(*e*) illustrates polymer swelling of the particle followed by gradual dissolution and pore formation. FIG. 1(*f*) illustrates Ni/Cu nanoparticles coated onto the surface of the Al/W particle where the Al is exposed into the solution. FIG. 1(*g*) illustrates an in situ Al/W particle coated with a layer of Ni or Cu followed by polymer removal. FIG. 1(*h*) illustrates multilayers of Ni or Cu nanoparticles coated onto the surface of the Al/W particle.

Figure 8:
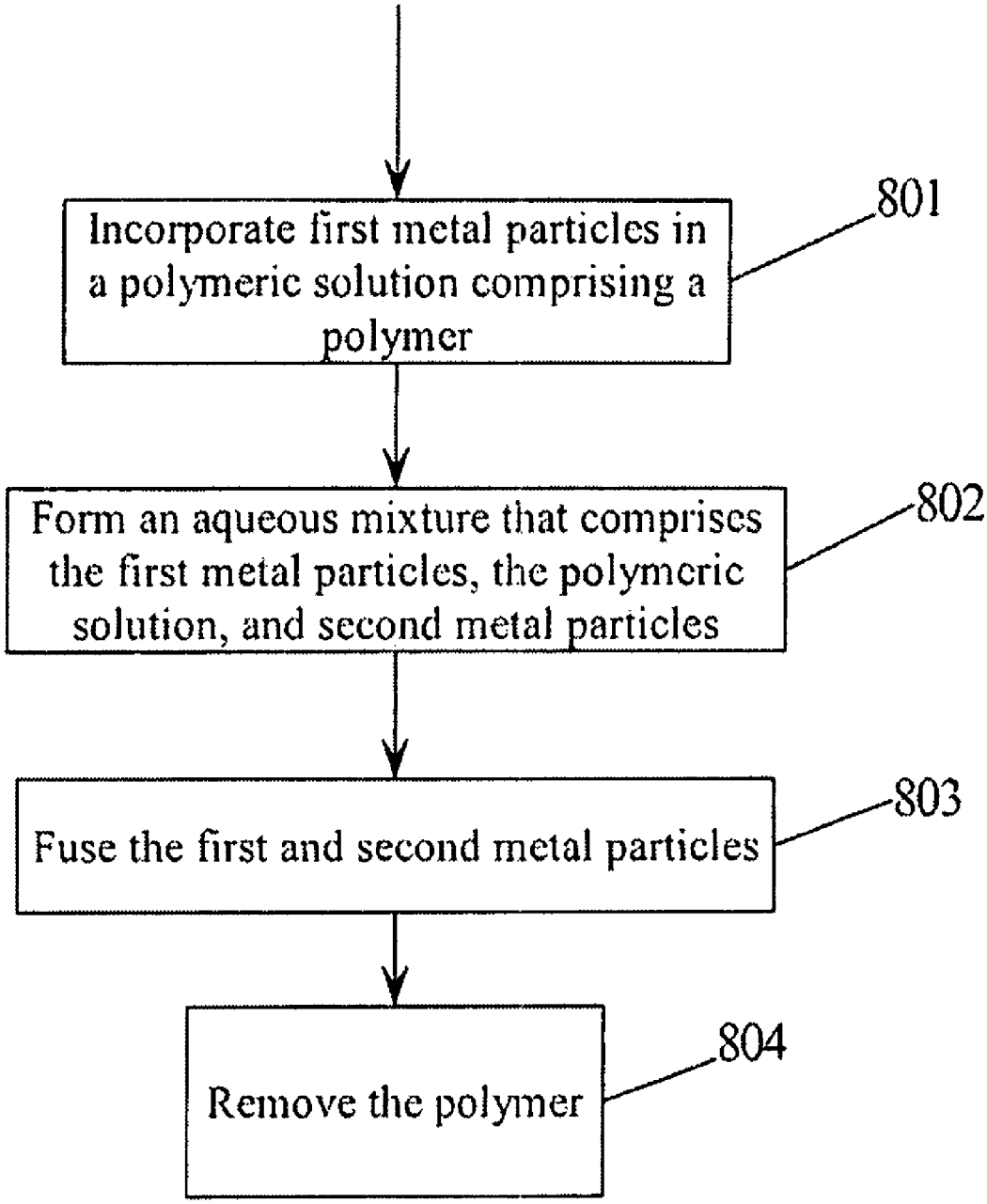
FIG. 8 illustrates a flow diagram of an embodiment of the present invention.

FIG. 8 illustrates a process for producing encapsulated particles:

incorporating first metal particles into a polymeric solution comprising a moisture or pH sensitive polymer, or mixture thereof (step 801);

(ii) forming an aqueous mixture comprising the first particles, the polymeric solution (a moisture or pH sensitive polymer, or mixture thereof), and second metal particles (step 802);

(iii) spray drying said mixture to form a dry powder composition (step 803);

(iv) fusing the two metal particles together (step 804);

(v) removing the polymer by incorporating the fused particles in water or in the appropriate pH solution (step 805).

Homogenization of the aqueous mixture may be performed in any suitable fashion with a variety of mixers known in the art such as simple paddle or ribbon mixers, although other mixers, such as ribbon or plow blenders, drum agglomerators, and high shear mixers may be used. Suitable equipment for this process includes a model Rannie 100 lab homogenizer (available from APV Gaulin, Inc., Everett, Mass.), a rotor stator high shear mixer (available from Silverson Machines, Inc., of East Long Meadow, Mass.), and other high shear mixers. The level of polymer, the concentration of the metal particles in the solution, and the pressure at which the high shear homogenization process may be performed controls the thickness of the coating.

The polymer is released from the fused metal particles in a water solution or when the pH of the surrounding environment reaches a desired level. Upon changes in pH, the particles' pH sensitive matrix material dissolves or swells. The dissolution or swelling of the matrix disrupts the microsphere structure and facilitates the release of the polymer leaving the coated metal particles.

Any material and structural form may be used as the pH-sensitive or salt-sensitive trigger means that maintains the integrity of the micro-sphere until triggered by a solution of the desired pH. The trigger pH may be between approximately 3 to 12, although in some applications it may be higher or lower. More specifically, the trigger pH may be from approximately 6 to 7 for a specific application as disclosed herein. The trigger pH is the threshold pH value or range of values at which either above or below the trigger pH the pH-sensitive material degrades, and/or dissolves. The microsphere may be formed to be stable in solutions, and then as the pH rises above the trigger pH, the micro-spheres are activated. Likewise, micro-spheres may be formed to be stable in solutions, and as the pH drops below the trigger pH, the micro-spheres are activated. Once activated, the active ingredients and nano-spheres are released.

A pH-sensitive trigger means is used to hold together two metal particles portions. The trigger means is capable of losing its adhesive quality or strength, such as to degrade or dissolve, following triggering by a solution of the desired pH, either above or below the trigger pH, or following a change in salt concentration.

The pH-sensitive materials may be insoluble solids in acidic or basic aqueous solutions, which dissolve, or degrade and dissolve, as the pH of the solution is neutral, or rises above or drops below a trigger pH value.

Examples of pH-sensitive materials include copolymers of acrylate polymers with amino substituents, acrylic acid esters, polyacrylamides, phthalate derivatives (i.e., compounds with covalently attached phthalate moieties) such as acid phthalates of carbohydrates, amylose acetate phthalate, cellulose acetate phthalate, other cellulose ester phthalates, cellulose ether phthalates, hydroxy propyl cellulose phthalate, hydroxypropyl ethylcellulose phthalate, hydroxypropyl methyl cellulose phthalate, methyl cellulose phthalate, polyvinyl acetate phthalate, polyvinyl acetate hydrogen phthalate, sodium cellulose acetate phthalate, starch acid phthalate, styrene-maleic acid dibutyl phthalate copolymer, styrene-maleic acid polyvinyl acetate phthalate copolymer, styrene and maleic acid copolymers, formalized gelatin, gluten, shellac, salol, keratin, keratin sandarac-tolu, ammoniated shellac, benzophenyl salicylate, cellulose acetate trimellitate, cellulose acetate blended with shellac, hydroxypropylmethyl cellulose acetate succinate, oxidized cellulose, polyacrylic acid derivatives such as acrylic acid and acrylic ester copolymers, methacrylic acid and esters thereof, vinyl acetate and crotonic acid copolymers.

Examples of suitable pH sensitive polymers for use are the EUDRAGIT® polymers series from Rohm America Inc., a wholly-owned subsidiary of Degussa-Huls Corporation, headquartered in Piscataway, N.J., and an affiliate of Rohm GmbH of Darmstadt, Germany. EUDRAGIT® L 30 D-55 and EUDRAGIT® L 100-55, pH dependent anionic polymer that is soluble at pH above 5.5 and insoluble below pH 5. EUDRAGIT® L 100 pH dependent anionic polymer that is soluble at pH above 6.0. EUDRAGIT® S 100 pH dependent anionic polymer that is soluble at pH above 7. EUDRAGIT® E 100 and EUDRAGIT® EPO, pH dependent cationic polymer, soluble up to pH 5.0 and insoluble above pH 5.0.

One example of a polymer that may be used is EUDRAGIT® L 30 D-55 from Rohm America Inc., a wholly-owned subsidiary of Degussa-Huls Corporation, headquartered in Piscataway, N.J., and an affiliate of Rohm GmbH of Darmstadt, Germany. This pH dependent anionic polymer is soluble at pH above 6 and insoluble below pH 5.

Embodiments of the present invention may utilize the following:

I) Encapsulation of Metal Microparticles Process

Figure 2:
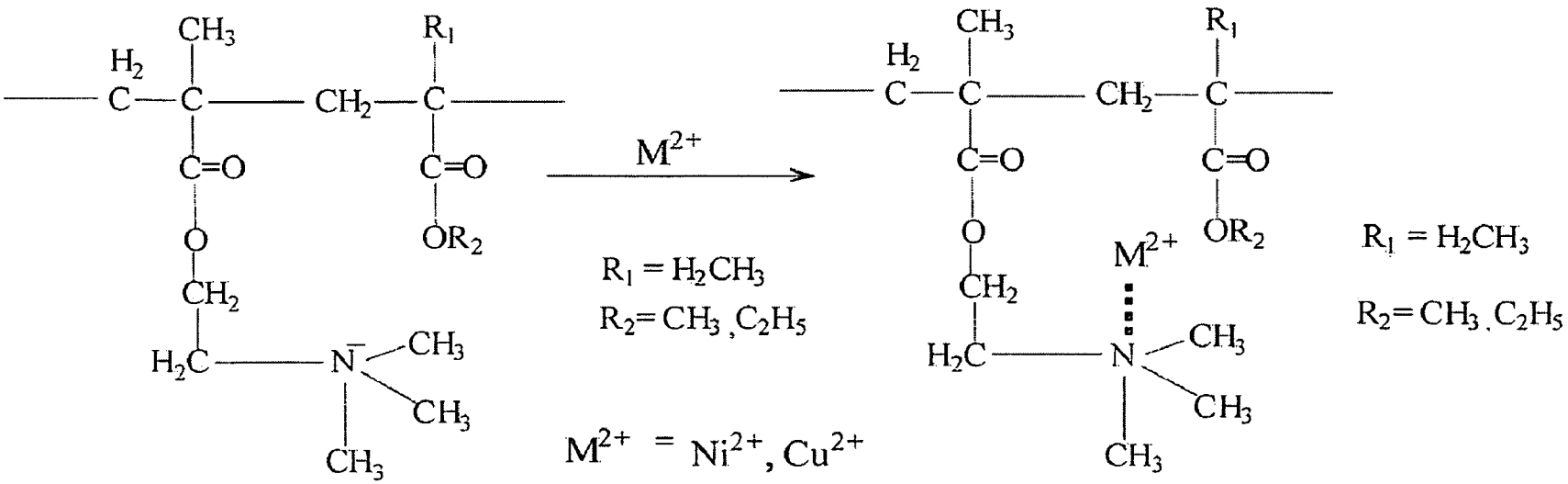
FIG. 2 illustrates the structure of an EUDRAGIT® monomer and metal encapsulation chemistry.
Figure 3:
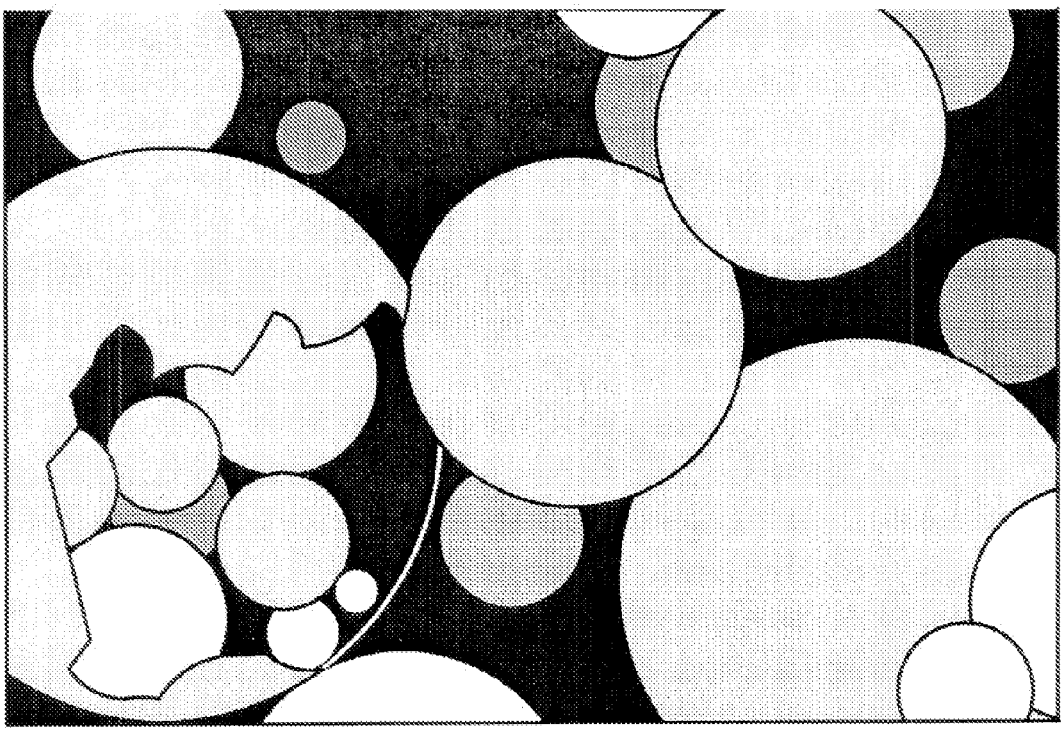
FIG. 3 illustrates nanospheres encapsulated with microspheres for multi-component delivery systems.

An encapsulation process may involve a coating formulation wherein Ni/Cu metal salts are dispersed in a solvent to formulate a Multisal™ suspension. Ni and Cu salts are known to bind well to the amine group in the backbone of an EUDRAGIT® polymer as shown in FIG. 2. EUDRAGIT® is a high molecular weight polymer (MW~150,000 Daltons) and has a lone pair of electrons on the nitrogen atom that facilitates the binding of the $Ni^{2+}$ and $Cu^{2+}$ ions. The polymer has ~500 units of monomer and 500 sites for the $Ni^{2+}/Cu^{2+}$ ion bonding during the encapsulation process. The Al/W microparticles are then added to the Multisal™ suspension to coat the particles uniformly with the layer of polymer with the $Ni^{2+}/Cu^{2+}$ ions. Altering the wt % of the polymer and the $Ni^{2+}/Cu^{2+}$ ion concentration in the solution can control the thickness of the coating. The polymer encapsulation process (e.g., see U.S. Pat. No. 6,042,792) has been demonstrated previously to provide uniform coating on microparticles of similar size regime. FIG. 3 shows an encapsulation of nanospheres within pH sensitive polymer micro-spheres for multi-component delivery systems. It has also been demonstrated previously that the polymer-encapsulated micro-spheres can be spray dried into a powder form. A similar process may be used in embodiments of the present invention.

Based on calculations, embodiments of the present invention utilize a ~3 μm Ni coating to prepare 70% Ni-30% Al wt % powders with ~20 μm Al microparticles and ~0.16 μm Cu coating to prepare 80% W-20% Cu wt % powders with ~0.5 μm W microparticles. A two-step approach coats the Al/W microparticles in an aqueous solvent of controlled pH. In a first process, the $Ni^{2+}/Cu^{2+}$ ions are reduced to their respective metals (Ni/Cu) in a polymer matrix using a reduction agent in the solution phase. Then, the polymer is removed from the coated metal particles by dissolving it in an aqueous solution with controlled pH. EUDRAGIT® is an emulsion polymer that has $Ni^{2+}/Cu^{2+}$ ions bound by ionic interactions (Van der Waals forces). When suspended in a solution of pH>7, the negatively charged groups are neutralized by the charged salt species resulting in polymer swelling. The swelling of the polymer matrix creates small pores followed by polymer dissolution. The kinetics of the electroless plating process is faster than the polymer dissolution process enabling uniform metal coating within the polymer matrix.

This electroless metal coating process and polymer removal yields a uniform coating of the 20 μm Al/0.5 μm W microparticles without agglomeration.

II) Suspension for Metal Encapsulation

Example 1

Encapsulation of $Ni^{2+}$ Ions

The suspension for encapsulation may be prepared by dissolving a known amount of $NiSO_4.7H_2O$ (~8 g/100 g Al particles) in a polymer suspension under controlled conditions. The cationic conditioning agent may be methylbis (hydrogenated ditallowamidoethyl) 2-hydroxyethyl ammonium chloride (commercially available from Croda Inc. as INCROSOFT 100). The micro-sphere anionic pH sensitive matrix may be EUDRAGIT® L 30 D-55. To prepare 100 grams of encapsulated powder, 8.23 grams nickel salt ($NiSO_4.7H_2O$) may be used. The nickel salt may be dissolved in 1000 grams of deionized water with ~9 grams of EUDRAGIT®. The suspension may be placed in a 1 gallon vessel and thoroughly mixed with a propeller mixer. The Ni salt containing polymer dispersion may be homogenized at 20,000 psi using a Rannie 100 lab homogenizer. The dispersion may be maintained at room temperature by passing it through a tube-in-tube heat exchanger (Model 00413, Exergy Inc.) to form a suspension. FIG. 4 shows the comparison of different materials required for encapsulating 100 grams of 20 μm Al particles. Based on calculations, 8.5 grams of NiCO4×7H2O is needed for coating thickness of Ni on 20 μm Al particles.

The homogenization of the suspension ensures that the Al/W microparticles are uniformly encapsulated. A model Rannie 100 lab homogenizer (APV Gaulin, Inc., Everett, Mass.) may be used for the high shear homogenization process. The amount of polymer, the concentration of the metal ions in the solution, and the pressure of the high shear homogenization process control the thickness of the coating. The encapsulation process may be carried out at pH of 1.2. The $Ni^{2+}$ ions are bonded to the amine group in the polymer backbone during the encapsulation process. The polymer chain has ~500 monomer units with the amine functionality (~MW 300 g/mol) creating a minimum of 500 bonding sites for the $Ni^{2+}$ ions. This bonding chemistry ensures good adhesion of $Ni^{2+}$ ions within the encapsulated polymer matrix. The thickness of the particles before and after encapsulation may be analyzed to determine the thickness of polymer using a Diffraction Particle Size Analyzer.

Electroless Reduction of $Ni^{2+}$ to Nickel Metal:

An alkaline bath may be used to coat nickel on aluminum (~97% purity coating) microparticles. The composition of the alkaline bath may be:

1. Ni salt ($NiSO_4.7H_2O$) provides $Ni^{2+}$. (Note that other salts may be used, such as $NiCl_2.6H_2O$) Concentration 25 grams per liter.
2. Reducer [$(CH_3)_2NHBH_3$]) Reduces $Ni^{2+}$ to Ni. Concentration 4 grams per liter.
3. Promoter to dissolve the Ni salt in the solution ($C_4H_5Na_2O_4.6H_2O$). Concentration 25 grams per liter.
4. Solution to slow the reaction ($Na_4P_2O_7.10H_2O$). Concentration 15 grams per liter.

The reaction may be carried out at a pH of 7 at 60° C. under a stirring rate of 5-7 μm/h.

Example 2

Encapsulation of $Cu^{2+}$ Ions

The suspension may be prepared by dissolving a known amount (~1.9 g/100 g of W particles) of $CuSO_4.7H_2O$ in the polymer suspension under controlled conditions. The cationic conditioning agent may be methylbis (hydrogenated ditallowamidoethyl) 2-hydroxyethyl ammonium chloride (commercially available from Croda Inc. as INCROSOFT 100). The micro-sphere anionic pH sensitive matrix may be EUDRAGIT® L 30 D-55. To prepare 100 g of encapsulated powder, 1.9 g copper salt ($CuSO_4.5H_2O$, MW 250 g) is dissolved in 1000 grams of deionized water. The suspension preparation procedure is same as described for nickel in Example 1. The level of polymer, the concentration of the $Cu^{2+}$ ions in the solution, and the pressure at which the high shear homogenization process controls the thickness of the polymer coating. The $Cu^{2+}$ ions may be bonded to the amine group in the polymer backbone during the encapsulation process. The polymer chain has ~500 monomer units with the amine functionality (~MW 300 g/mol) creating a minimum of 500 bonding sites for the $Cu^{2+}$ ions. This bonding chemistry ensures good adhesion of $Cu^{2+}$ ions within the encapsulated polymer matrix. The thickness of the particles before and after encapsulation may be analyzed to determine the thickness of polymer using a Diffraction Particle Size Analyzer. FIG. 5 shows a comparison of different materials required for encapsulating 100 gm of ~1 μm W particles.

Based on calculations, ~1.9 g of $CuSO_4.5H_2O$ may be used for a median 0.45 μm coating thickness of Cu on 1 μm W particles.

III) Electroless Reduction of Cu Ions to Copper Metal 0.5-1 μm W particles may be coated with a uniform layer of copper by a electroless coating process. The plating chemicals are first dissolved in a water solution. Deposition occurs automatically as soon as the solution reaches a specific pH value (7.0) and specific temperature (70° C.). A stirrer keeps working during the reaction to disperse the powders in the solution. This results in each powder being coated with a continuous Cu nanofilm on the surface. The electroless bath composition may be as follows:

1. Cu salt ($CuSO_4.5H_2O$) provides $Cu^{2+}$. (Note that other salts may be used, such as $CuCl_2.6H_2O$). Concentration 0.025 mol per liter.
2. Reducer ($NaH_2PO_3.H_2O$). Reduces $Cu^{2+}$ to Cu. Concentration 0.1 mol per liter.
3. Promoter to dissolve the Cu salt in the solution ($Na_3C_6H_5O_7.2H_2O$). Concentration 0.3 mol per liter.
4. Catalyst to slow the reaction ($NiSO_4.7H_2O$). Concentration 0.1 mol per liter.
5. The reaction may be carried out at a pH of 7 at 70° C. under a stirring rate of 5-7 μm/h.

IV) In Situ Metal Coating and Polymer Removal Process

Embodiments of the present invention disclose a two-step coating process:

(a) The $Ni^{2+}/Cu^{2+}$ ions form the nucleation sites on metal microparticles (Al/W) within the polymer matrix and instantly form a monolayer of nickel/copper on Al/W microparticles when the metal reducing agent reaches the ionic polymer matrix (FIG. 1(*g*)). The monolayer coating of the microparticles helps prevent particle agglomeration in the electroless bath. Since the $Ni^{2+}/Cu^{2+}$ are bonded to the amine functionality in the Eudragit polymer backbone, the reduction of metal ions favors deposition on the Al/W microparticles. A rough surface on metal nanoparticles is generally useful for electroless plating. Performed is an acid treatment (FIG. 1(*b*)) of the Al/W microparticles prior to encapsulation if needed.

(b) Electroless coating chemistry controls the coating thickness on the Al/W microparticles. A predetermined amount of $Ni^{2+}/Cu^{2+}$ ions are encapsulated within the polymer matrix, and the ions reduce to metal. A calibration curve between rate of electroless coating and polymer removal is used to estimate the coating efficiency. By this method, uniform coating on individual Al/W particles (FIG. 1(*g*)) is achieved.

Figure 6:
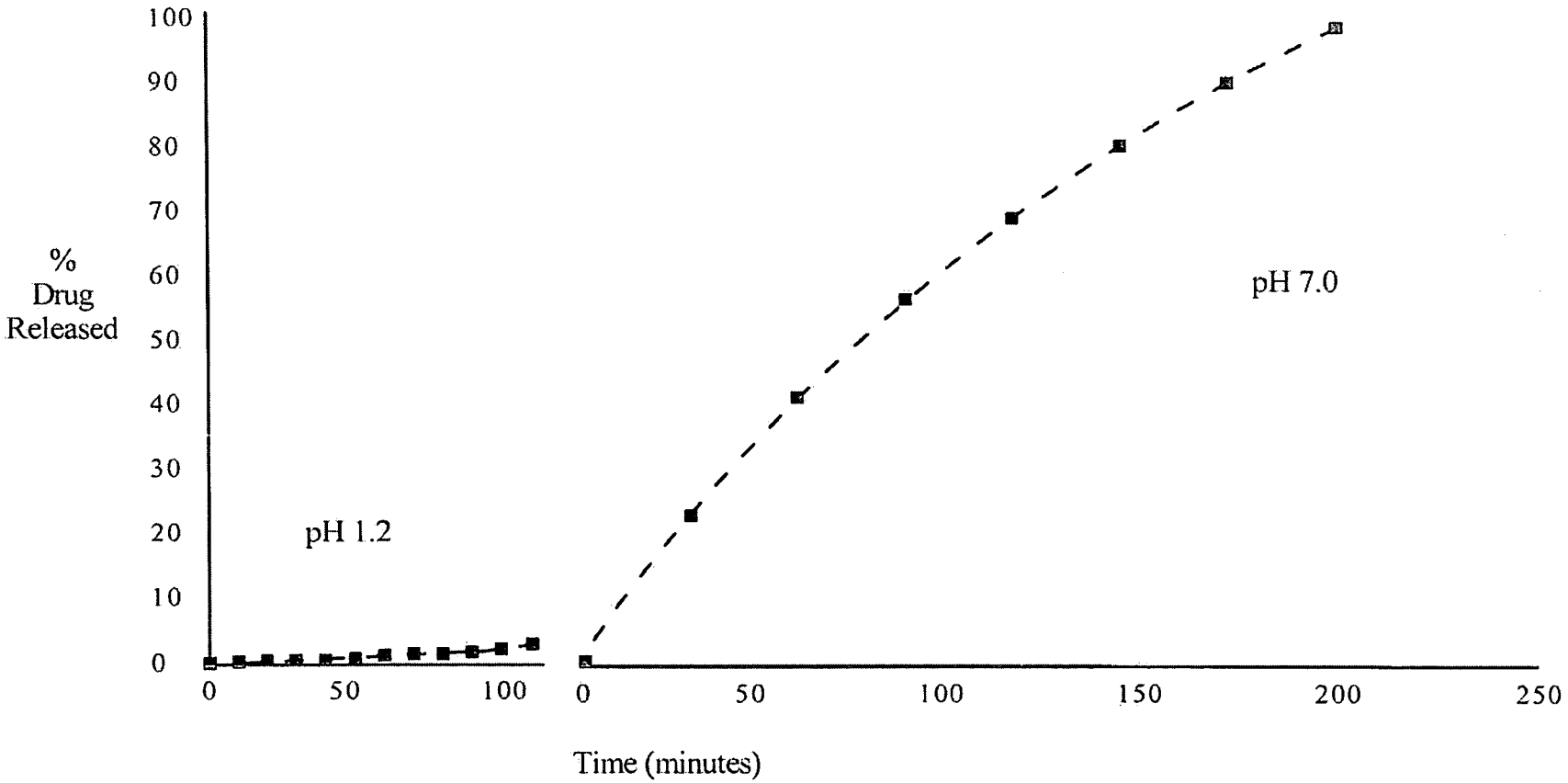
FIG. 6 illustrates release kinetics of particulates under different pH conditions.

The polymer may be released from the coated metal particles in aqueous solution when the pH of the reaches a desired level. Upon changes in pH, the particles pH sensitive matrix material dissolves or swells. The dissolution or swelling of the matrix disrupts the micro-sphere structure and facilitates the release of the polymer leaving the coated metal particles in solution. The resulting encapsulated powders are storage stable without a need for preservatives. FIG. 6 shows release kinetics of a particulate that was encapsulated using a similar process under different pH conditions. It can be seen that at pH 7.0, there is release due to polymer dissolution and there is no polymer dissolution at pH 1.2 showing the specificity of the process.

V) Spray Drying Process

Figure 7:
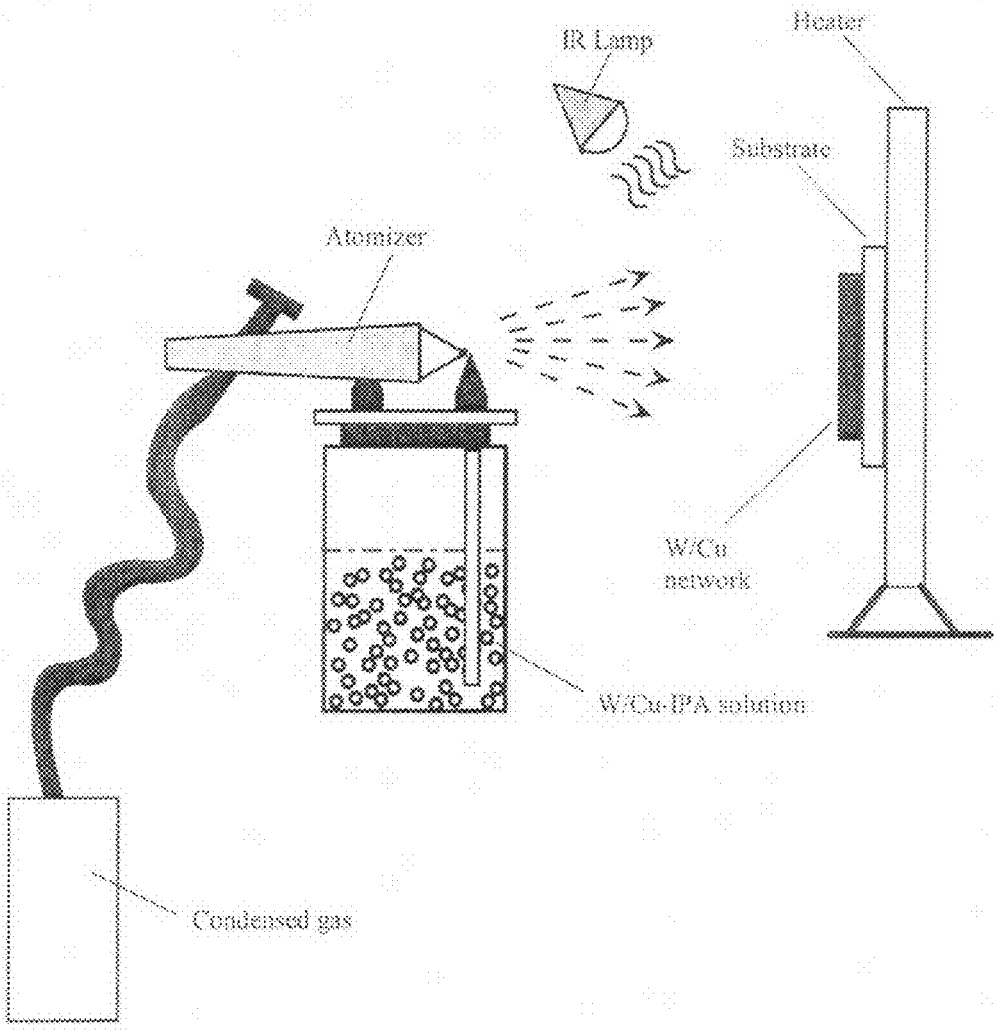
FIG. 7 illustrates an apparatus for spray drying encapsulated powders.

In embodiments of the present invention, the encapsulation is performed in a solution phase. Dry encapsulated powders may be collected from the solution and spray dried to form dry powders. The coated microparticles may be sprayed using an airbrush through a carrier of IPA onto the substrate with a thickness of 1-2 μm. FIG. 7 shows a schematic diagram of such an apparatus. Prepared are 10 lbs of 70% Ni-30% Al wt % and 80% W-20% Cu wt % by this process. This process may be used to prepare other dry encapsulated powders as well. Prepared are 10 batches of powder coatings of 1 lb batch size each.

Although the present invention and its advantages have been described in detail, it should be understood that various changes, substitutions and alterations can be made herein without departing from the spirit and scope of the invention as defined by the appended claims. The invention can be extended to other metals such as manganese, cobalt and chromium, among others.

The invention claimed is:

1. A method for producing encapsulated particles, comprising:

incorporating first metal particles in a polymeric solution comprising a polymer;

forming an aqueous mixture comprising the first metal particles, the polymeric solution and second metal particles;

fusing together the first and second metal particles; and removing the polymer to thus produce an encapsulation of the second metal particles coated with the first metal particles.

2. The method as recited in claim 1, wherein the polymer is moisture sensitive.

3. The method as recited in claim 1, wherein the polymer is pH sensitive.

4. The method as recited in claim 3, wherein the pH of the polymeric solution is between 3 and 12.

5. The method as recited in claim 1, wherein the polymer solution comprises a mixture of moisture sensitive and pH sensitive polymers.

6. The method as recited in claim 1, further comprising spray drying the aqueous mixture to form a dry powder composition before the fusing step.

7. The method as recited in claim 1, wherein the polymer is removed by incorporating the fused particles in water.

8. The method as recited in claim 1, wherein the polymer is removed by incorporating the fused particles in a solution having a specified pH.

9. The method as recited in claim 8, wherein the specified pH dissolves the polymer.

10. The method as recited in claim 8, wherein the specified pH swells the polymer.

11. The method as recited in claim 8, wherein the specified pH is between approximately 3 and 12.

12. The method as recited in claim 8, wherein the specified pH is between approximately 6 and 7.

13. The method as recited in claim 1, wherein the aqueous mixture promotes removal of the polymer thus coating the second metal particles with the first metal particles.

14. The method as recited in claim 13, wherein the removing of the polymer results from pores formed in the polymer coating the second metal particles and a resultant dissolution of the polymer.

15. The method as recited in claim 1, further comprising pretreating the second metal particles with an acid to form nucleation sites for the polymer before incorporating the second metal particles in the polymeric solution comprising the polymer and the first metal particles.

16. The method as recited in claim 1, wherein after incorporating the second metal particles in the polymeric solution comprising the polymer and the first metal particles, the second metal particles are coated with the polymer.

17. The method as recited in claim 16, wherein after incorporating the second metal particles in the polymeric solution comprising the polymer and the first metal particles, the second metal particles are coated with the polymer and with the first metal particles over the polymer.

18. A method for producing encapsulated particles, comprising:

incorporating first metal particles in a polymeric solution comprising a moisture sensitive polymer;

forming an aqueous mixture comprising the first metal particles, the polymeric solution and second metal particles;

fusing together the first and second metal particles; and removing the moisture sensitive polymer, wherein the aqueous mixture promotes removal of the moisture sensitive polymer thus coating the second metal particles with the first metal particles since the moisture sensitive polymer dissolves in a presence of the aqueous mixture.

19. A method for producing encapsulated particles, comprising:

incorporating first metal salts in a polymeric solution;

forming an aqueous mixture comprising the first metal salts, the polymeric solution, and second metal particles; and fusing together metal particles formed from the first metal salts with the second metal particles as the polymer is removed to thus produce an encapsulation of the second metal particles coated with the first metal particles.

* * * * *